US011415363B2

(12) United States Patent
Lim et al.

(10) Patent No.: US 11,415,363 B2
(45) Date of Patent: Aug. 16, 2022

(54) REFRIGERATOR INCLUDING LIGHT EMITTING DIODE ASSEMBLY

(71) Applicant: SAMSUNG ELECTRONICS CO., LTD., Suwon-si (KR)

(72) Inventors: Chae Soo Lim, Hwaseong-si (KR); Byeong Kook Kang, Gwangju (KR); Tae-In Eom, Hwaseong-si (KR); Jong-Hoon Oh, Gwangju (KR); Sang Chul Ryu, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/944,960

(22) Filed: Jul. 31, 2020

(65) Prior Publication Data

US 2020/0363124 A1 Nov. 19, 2020

Related U.S. Application Data

(62) Division of application No. 15/861,216, filed on Jan. 3, 2018, now Pat. No. 10,775,098.
(Continued)

(30) Foreign Application Priority Data

Jun. 22, 2017 (KR) ..... 10-2017-0079113

(51) Int. Cl.
*F25D 23/06* (2006.01)
*F25D 11/02* (2006.01)
(Continued)

(52) U.S. Cl.
CPC ..... *F25D 23/068* (2013.01); *F25D 11/02* (2013.01); *F25D 17/02* (2013.01); *F25D 23/067* (2013.01); *F25D 27/00* (2013.01); *F25D 2400/40* (2013.01)

(58) Field of Classification Search
CPC ..... F25D 23/068; F25D 23/067; F25D 11/02; F25D 27/00; F25D 17/02; F25D 2400/40
(Continued)

(56) References Cited

U.S. PATENT DOCUMENTS

2010/0061079 A1 3/2010 Li et al.
2011/0056222 A1 3/2011 Lee et al.
(Continued)

FOREIGN PATENT DOCUMENTS

JP 6-147738 5/1994
JP 06-147738 A 5/1994
(Continued)

OTHER PUBLICATIONS

Notice of Preliminary Rejection in Korean Office Action dated Jun. 7, 2021 for Korean Application No. 10-2017-0079113.
(Continued)

*Primary Examiner* — Steve S Tanenbaum
(74) *Attorney, Agent, or Firm* — Staas & Halsey LLP

(57) ABSTRACT

A refrigerator including fixers for fixing various components to an inner case and a light emitting diode (LED) assembler in which a printed circuit board having an LED mounted thereon is assembled and which is integrally provided in the inner case. The refrigerator includes an inner case configured to form a storage compartment, an outer case coupled to an outer side of the inner case to form an exterior, a plurality of components fixed to a rear plate of the inner case, and a plurality of fixers integrally formed at the rear plate of the inner case to fix the plurality of components thereto, wherein the plurality of fixers are injection-molded along with the rear plate of the inner case.

6 Claims, 16 Drawing Sheets

Related U.S. Application Data

(60) Provisional application No. 62/441,783, filed on Jan. 3, 2017.

(51) Int. Cl.
*F25D 27/00* (2006.01)
*F25D 17/02* (2006.01)

(58) Field of Classification Search
USPC ..... 62/521
See application file for complete search history.

(56) References Cited

U.S. PATENT DOCUMENTS

| | | | | |
|---|---|---|---|---|
| 2014/0119032 | A1 | 5/2014 | Wimbert et al. | |
| 2015/0292795 | A1* | 10/2015 | Shin | F25D 23/028 312/404 |
| 2016/0305706 | A1 | 10/2016 | Lim | |

FOREIGN PATENT DOCUMENTS

| | | | | |
|---|---|---|---|---|
| JP | 2008-041605 | A | 2/2008 | |
| JP | 2010-43814 | | 2/2010 | |
| JP | 2012-154624 | | 8/2012 | |
| JP | 2013-119985 | | 6/2013 | |
| JP | 2013-119985 | A | 6/2013 | |
| JP | 2012-154624 | A | 8/2016 | |
| KR | 20-1999-0014771 | U | 5/1999 | |
| KR | 1999-0014553 | | 5/1999 | |
| KR | 1999-0014771 | | 5/1999 | |
| KR | 10-2006-0032523 | | 4/2006 | |
| KR | 10-2006-0032523 | A | 4/2006 | |
| KR | 10-2006-0036192 | | 4/2006 | |
| WO | WO-2015087300 | A1 * | 6/2015 | F25D 23/066 |

OTHER PUBLICATIONS

U.S. Notice of Allowance dated May 29, 2020 in U.S. Appl. No. 15/861,216.
U.S. Office Action dated Mar. 9, 2020 in U.S. Appl. No. 15/861,216.
U.S. Office Action dated Sep. 24, 2019 in U.S. Appl. No. 15/861,216.
U.S. Office Action dated Jul. 18, 2019 in U.S. Appl. No. 15/861,216.
U.S. Appl. No. 15/861,216, filed Jan. 3, 2018, Chae Soo Lim, et al., Samsung Electronics Co., Ltd.
Office Action dated Jan. 17, 2022 issue in Korean Application No. 10-2017-0079113.
Office Action dated May 30, 2022 in Korean Application No. 10-2022-0016438.
U.S. Appl. No. 15/861,216, filed Jan. 3, 2018, Chae Soo Lim, Assignee Samsung Electronics Co., Ltd.

* cited by examiner

REFRIGERATOR INCLUDING LIGHT EMITTING DIODE ASSEMBLY

CROSS-REFERENCE TO RELATED APPLICATION

This application is a divisional application of U.S. patent application Ser. No. 15/861,216 filed on Jan. 3, 2018, which claims the benefit of U.S. Provisional Application No. 62/441,783, filed on Jan. 3, 2017 in the United States Patent and Trademark Office and Korean Patent Application No. 10-2017-0079113, filed on Jun. 22, 2017 in the Korean Intellectual Property Office, the disclosure of which is incorporated herein by reference.

BACKGROUND

1. Field

Embodiments of the present disclosure relate to a refrigerator including fixers integrally formed with an inner case and configured to fix various components fixed to the inner case.

2. Description of the Related Art

Generally, a refrigerator is a device including a storage compartment and a cold air supply device supplying cold air to the storage compartment and is configured to freshly store food.

A temperature of the storage compartment is maintained within a predetermined temperature range required to freshly store food.

The storage compartment has an open front side, and the open front side is normally closed by a door so that the temperature of the storage compartment is maintained.

The storage compartment is divided into an upper storage compartment and a lower storage compartment by a partition wall, and the lower storage compartment is divided into a first storage compartment and a second storage compartment respectively provided at left and right sides thereof.

Generally, an inner case is formed through a vacuum forming method in which a resin sheet is heated and stretched, the stretched sheet is placed on one side of a mold, and air is suctioned from the opposite side of the mold so that the heated sheet covers the mold or is suctioned inside the mold by a suction force.

In the case in which the inner case is formed through the vacuum forming method, after the inner case is formed, a fixer for fixing various components to the inner case should be separately manufactured and coupled to the inner case.

SUMMARY

Therefore, it is an aspect of the present disclosure to provide a refrigerator including fixers for fixing various components to an inner case and a light emitting diode (LED) assembler on which a printed circuit board having the LED mounted thereon is assembled, which are integrally provided in the inner case.

Additional aspects of the disclosure will be set forth in part in the description which follows and, in part, will be apparent from the description, or may be learned by practice of the disclosure.

In accordance with one aspect of the present disclosure, a refrigerator has an inner case configured to form a storage compartment, an outer case coupled to an outer side of the inner case to form an exterior, a plurality of components fixed to a rear plate of the inner case, and a plurality of fixers integrally formed at the rear plate of the inner case to fix the plurality of components thereto, wherein the plurality of fixers are injection-molded along with the rear plate of the inner case.

The plurality of refrigerator components includes a suction pipe and the plurality of fixers may include a suction pipe fixer to fix the suction pipe.

The plurality of components may include a plurality of suction pipe fixers respectively including an inserter configured to form an opening into which the suction pipe is inserted and a mounter on which the inserted suction pipe is mounted.

The plurality of suction pipe fixers may be made of an elastic material so that the suction pipe is easily inserted or separated through the opening.

The plurality of fixers may include a main wire fixer for fixing a main wire.

The plurality of components includes a plurality of main wire fixers respectively including a first fixer and a second fixer provided to be separated from each other to form a space into which the main wire is inserted.

The plurality of components includes a main wire and the plurality of fixers may include a wire housing fixer to fix the wire housing.

The wire housing fixer may include an inclined part provided to protrude from the rear plate of the inner case to have an inclined surface, and a connection hole configured to be connected to the wire housing.

The wire housing may include a connector inserted into the connection hole, and a sealer configured to seal around the connection hole to prevent an insulator foamed in a space between the inner case and the outer case from passing through the connection hole.

The plurality of components includes a shelf reinforcing plate and the plurality of fixers may include a shelf reinforcing plate fixer to fix the shelf reinforcing plate.

The plurality of components includes a screw and the plurality of fixers may include a screw fastener to which the screw is fastened and fixed.

In accordance with another aspect of the present disclosure, a refrigerator includes an inner case including an upper plate, a lower plate, a left plate, a right plate, a rear plate, and a front cover to form a storage compartment, an outer case coupled to an outer side of the inner case to form an exterior, and a light emitting diode (LED) assembly provided on at least one of an upper surface, a left surface, and a right surface of the front cover to be disposed in the storage compartment, wherein the LED assembly includes a printed circuit board on which a plurality of LEDs are mounted, an LED assembler provided to be integrated with the front cover and configured to form a space to assemble the printed circuit board so that the printed circuit board is assembled therein, and an LED cover configured to cover the LEDs to prevent exposure of the LEDs.

The LED assembler may be provided on all of the upper surface, the left surface, and the right surface of the front cover.

The LED assembler may be concave toward the outer case from the upper surface, the left surface, and the right surface of the front cover to form a space to assemble the printed circuit board.

The printed circuit board may include a first surface on which the LEDs are mounted and a second surface which is a surface opposite the first surface.

The LED assembler may include a first fixing rib to which one side of the first surface is fixed, a fixing hook to which the other side of the first surface is fixed, and a supporting rib configured to support the second surface of the printed circuit board so that the printed circuit board is fixed to the first fixing rib and the fixing hook.

The LED assembler may further include a second fixing rib to which one side of the LED cover is fixed.

Catchers are provided at the left plate, the right plate, and the upper plate which are coupled to the front cover and the other side of the LED cover may be caught by catchers to be fixed, and the catchers may be provided at the left plate, the right plate, and the upper plate, which are coupled to the front cover.

The LED cover may include a first fixing protrusion fixed to the second fixing rib and a second fixing protrusion fixed to one the catchers.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
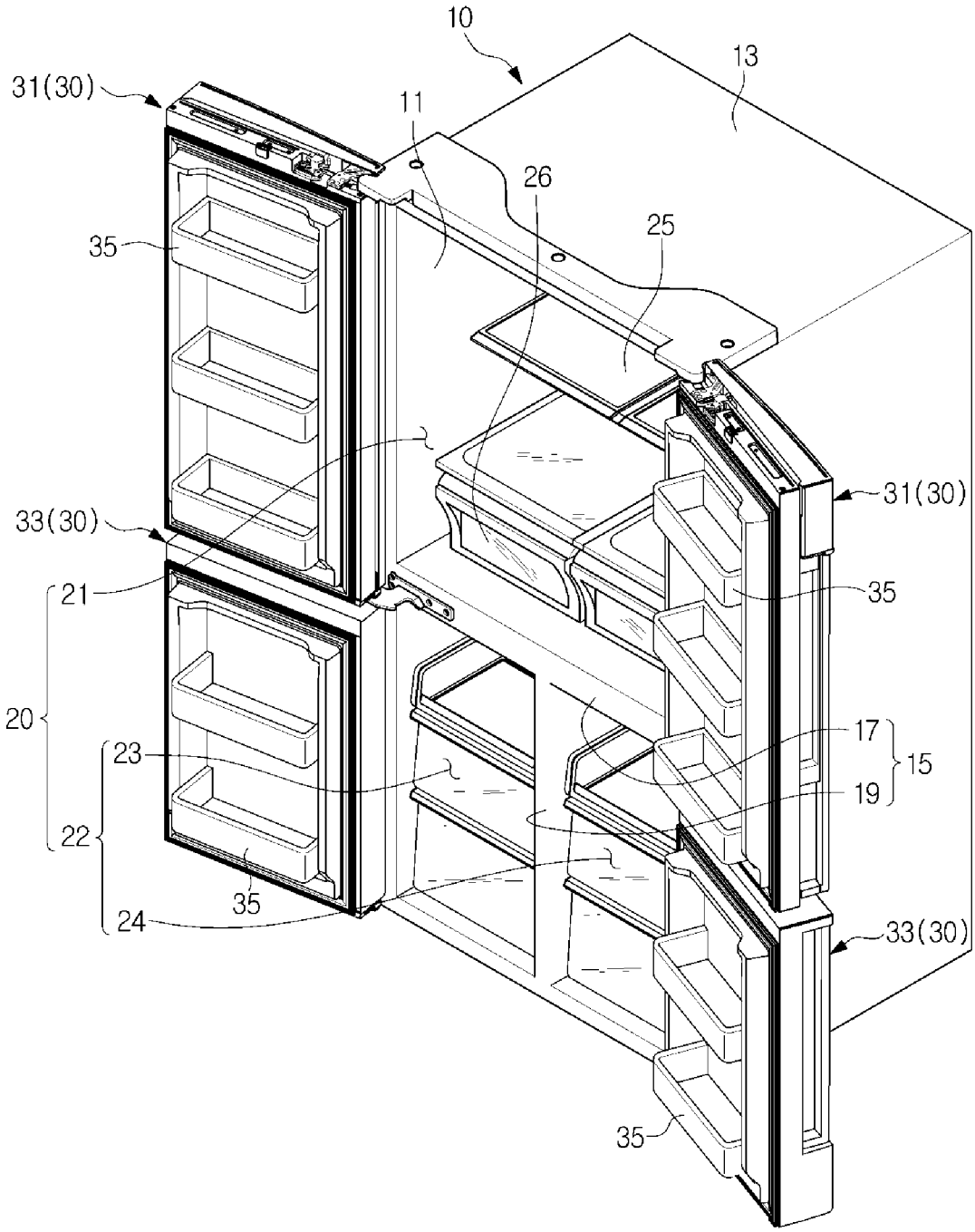
FIG. 1 is a perspective view of a refrigerator according to one embodiment of the present disclosure.

Embodiments described in this specification and configurations illustrated in drawings are only exemplary examples of the present disclosure, and there may be various modifications that may substitute for the embodiments and the drawings in the specification at the time of this application's filing.

Further, the same reference number or symbols disclosed in each of the drawings of the specification denote identical components or configurations which perform substantially the same functions.

Terms used in the present disclosure specification are only used to describe specific exemplary embodiments and do not limit the present disclosure. Singular forms used herein are intended to include plural forms unless explicitly indicated otherwise. It should be further understood that the terms "comprises" or "have" used in this specification specify the presence of stated features, numerals, steps, operations, components, parts, or a combination thereof, but do not preclude the presence or addition of one or more other features, numerals, steps, operations, components, parts, or a combination thereof.

In addition, the terms including ordinal numbers such as "first," "second," and the like used herein may be used to explain various components, but the components are not limited by the terms. The terms are only used to differentiate one component from other components. For example, a first component may be referred to as a second component without departing from the scope of the present disclosure, and a second component may also be similarly referred to as a first component. The term "and/or" includes any one or a combination of the relevant described items.

Meanwhile, the terms used in the following description, such as "front end," "rear end," "upper portion," "lower portion," "upper end," and "lower end," are defined on the basis of the drawings, and the shape and position of each component are not limited by the terms.

Generally, a refrigerator may be classified by a form of a storage compartment or a door.

A refrigerator includes a top mounted freezer (TMF)-type refrigerator including a storage compartment vertically divided by a horizontal partition wall into a freezing compartment formed at an upper side thereof and a refrigerating compartment formed at a lower side thereof, and a bottom mounted freezer (BMF)-type refrigerator including a refrigerating compartment formed at an upper side thereof and a freezing compartment formed at a lower side thereof.

Further, a refrigerator includes a side by side (SBS)-type refrigerator including a storage compartment horizontally divided by a vertical partition wall into a freezing compartment formed at one side thereof and a refrigerating compartment formed at the other side thereof, and a French door refrigerator (FDR)-type refrigerator including a storage compartment vertically divided by a horizontal partition wall into a refrigerating compartment formed at an upper side thereof and a freezing compartment formed at a lower side thereof, wherein the refrigerating compartment at the upper side thereof is opened or closed by a pair of doors.

The FDR-type refrigerator will be described in the embodiment for convenience of description, but the embodiment is not limited thereto.

Hereinafter, embodiments of the present disclosure will be described in detail with reference to the accompanying drawings.

FIG. 1 is a perspective view of a refrigerator according to one embodiment of the present disclosure.

As shown in FIG. 1, the refrigerator includes a main body 10, a plurality of storage compartments 20 provided in the main body 10 so that front sides thereof are open, and doors 30 opening and closing the open front sides of the storage compartments 20.

The main body 10 includes an inner case 11 forming the storage compartment 20, an outer case 13 forming an exterior thereof, and a cold air supply device (not shown) supplying cold air to the storage compartment 20.

The cold air supply device may include a compressor (not shown), a condenser (not shown), an expansion valve (not shown), an evaporator (not shown), a blower fan (not shown), a cold air duct (not shown), and the like, and an insulator (not shown) is foamed in a space between the inner case 11 and the outer case 13 of the main body 10 to prevent cold air in the storage compartment 20 from being discharged.

A machine room (not shown) in which the compressor for compressing a coolant and the condenser for condensing the compressed coolant are installed is provided at a lower rear side of the main body 10.

The storage compartment 20 may be divided into a plurality of storage compartments by partition walls 15, and the partition walls 15 may include a first partition wall 17 laterally coupled to the inside of the storage compartment 20 to divide the storage compartment 20 into an upper storage compartment 21 and a lower storage compartment 22, and a second partition wall 19 vertically coupled to the lower storage compartment 22 to divide the lower storage compartment 22 into a first storage compartment 23 and a second storage compartment 24.

The partition walls 15, which have a T shape due to the first partition wall 17 and the second partition wall 19 being coupled to each other, may divide the storage compartment 20 into three spaces.

The upper storage compartment 21 of the upper storage compartment 21 and the lower storage compartment 22 divided by the first partition wall 17 may be used as a refrigerating compartment, and the lower storage compartment 22 may be used as a freezing compartment.

The entire lower storage compartment 22 may be used as a freezing compartment, but the first storage compartment 23 may be used as a freezing compartment and the second storage compartment 24 may be used as a refrigerating compartment, and the first storage compartment 23 may be used as a freezing compartment and the second storage compartment 24 may be used as both a refrigerating compartment and a freezing compartment.

The division of the storage compartment 20 is one example, but the upper storage compartment 21 and the lower storage compartment 22 may be used differently from the above configuration, and the first storage compartment 23 and the second storage compartment 24 may also be used differently from the above configuration.

A plurality of shelves 25 and a plurality of storage containers 26 may be provided in the storage compartment 20 to store food therein.

The storage compartment 20 may be opened or closed by the door 30 rotatably coupled to the main body 10.

The doors 30 include a first door 31 rotatably coupled to the main body 10 to open and close the upper storage compartment 21 and a second door 33 rotatably coupled to the main body 10 to open and close the lower storage compartment 22.

A plurality of door guards 35 may be installed at a rear surface of the door 30 to store food.

Figure 2:
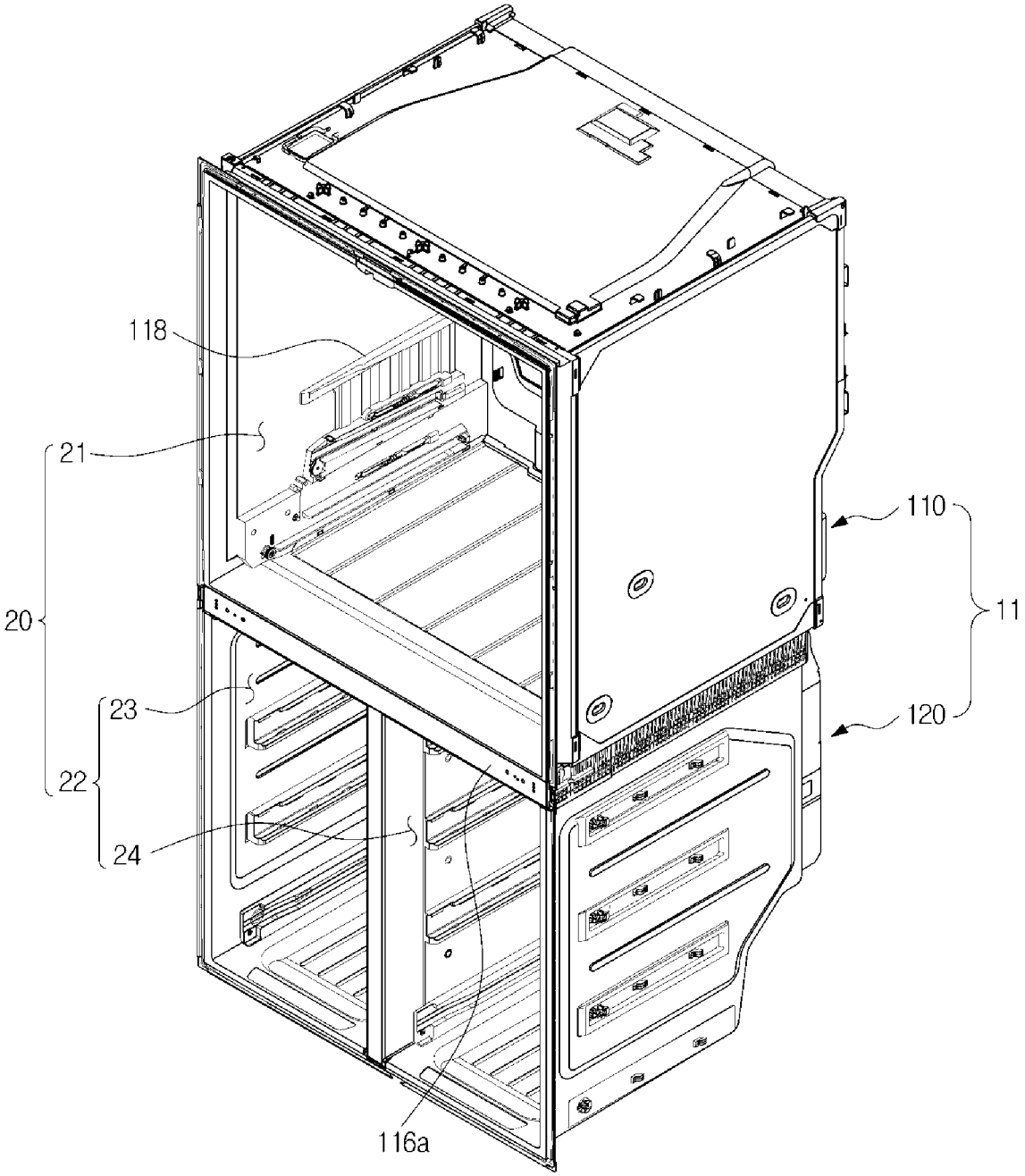
FIG. 2 is a view showing an inner case of the refrigerator according to one embodiment of the present disclosure.
Figure 3:
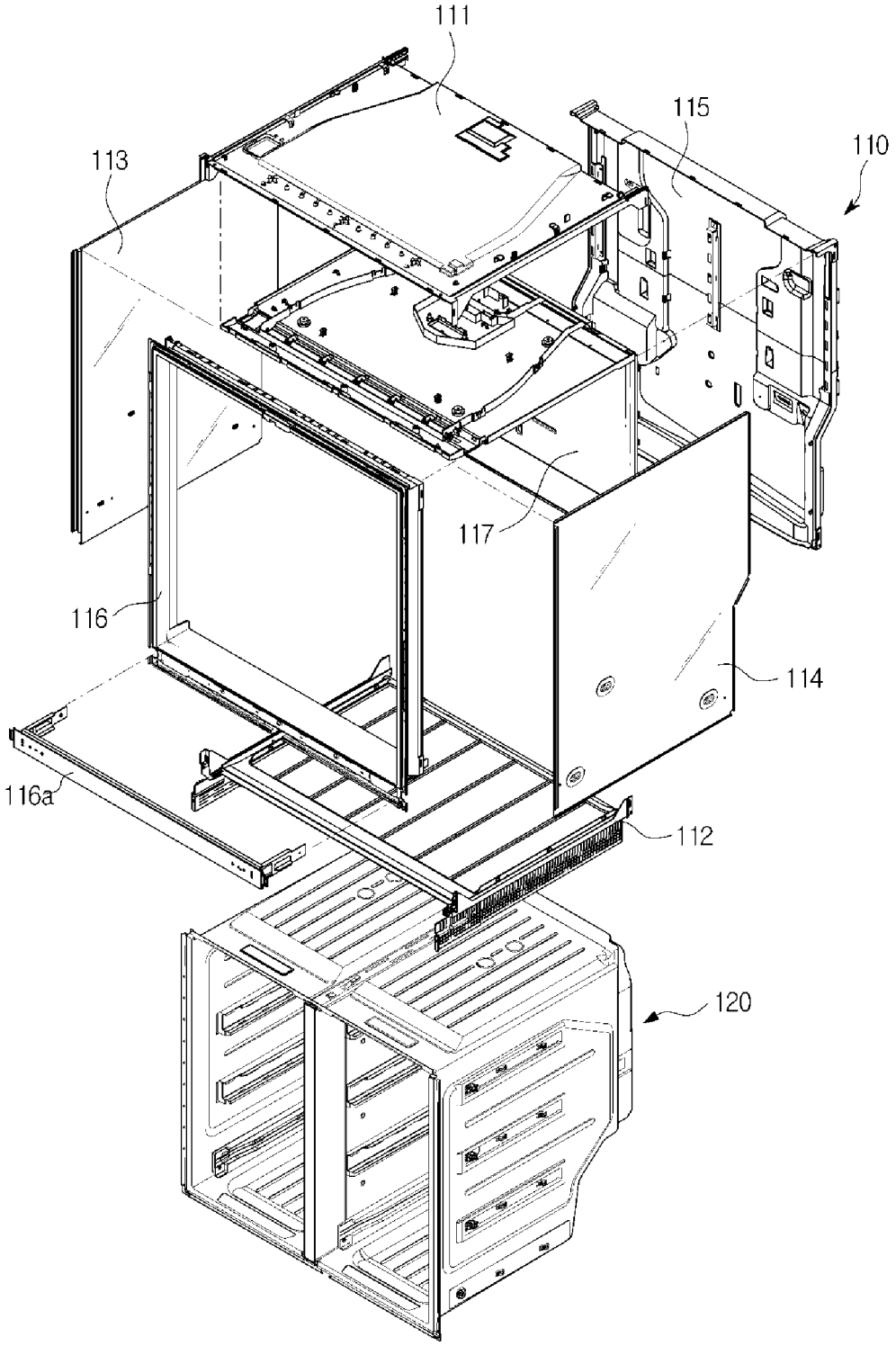
FIG. 3 is an exploded view showing the inner case of the refrigerator according to one embodiment of the present disclosure.

FIG. 2 is a view showing an inner case of the refrigerator according to one embodiment of the present disclosure, and FIG. 3 is an exploded view showing the inner case of the refrigerator according to one embodiment of the present disclosure.

As shown in FIGS. 1 to 3, the inner case 11 may include a first inner case 110 forming the upper storage compartment 21 and a second inner case 120 forming the lower storage compartment 22.

The first inner case 110 forming the upper storage compartment 21 is formed as an assembled-type inner case assembled with an injection-molded sheet forming each surface thereof, and the second inner case 120 forming the lower storage compartment 22 may be formed through a vacuum forming method.

In the drawings, the first inner case 110 is formed in the assembled-type inner case and the second inner case 120 is formed through the vacuum forming method, but the inner case is not limited thereto. The first inner case 110 may be formed through the vacuum forming method and the second inner case 120 may be formed as the assembled-type inner case, or both the first inner case 110 and the second inner case 120 may be formed as the assembled-type inner case.

The first inner case 110 forming the upper storage compartment 21 may include an upper plate 111, a lower plate 112, a left plate 113, a right plate 114, a rear plate 115, and a front cover 116.

A front reinforcing material **116*a* may be attached to a front side of the front cover 116 so that the door 30 and the like may be fixed to the front reinforcing material 116*a***.

A cold air duct cover 117 may be disposed under the upper plate 111 and in front of the rear plate 115, and a cold air duct supplying cold air to the storage compartment 20 may be formed between the upper plate 111 and the cold air duct cover 117 and between the rear plate 115 and the cold air duct cover 117.

The cold air duct cover 117 may be formed of various materials, such as a metal material, a resin material, and the like, and rails 118 may be attached to the left plate 113 and the right plate 114 of the first inner case 110 to be provided such that the shelf 25 or the storage container 26 may be installed thereon.

The first inner case 110 may be formed by assembling the upper plate 111, the lower plate 112, the left plate 113, the right plate 114, the rear plate 115, and the front cover 116, which are separately formed.

The upper plate 111, the lower plate 112, the rear plate 115, and the front cover 116 may be formed through injection-molding, and the left plate 113 and the right plate 114 may be formed of a ceramic or steel plate.

At least two members among the upper plate 111, the lower plate 112, the left plate 113, the right plate 114, the rear plate 115, and the front cover 116 may be assembled through an insert-fitting method.

Figure 4:
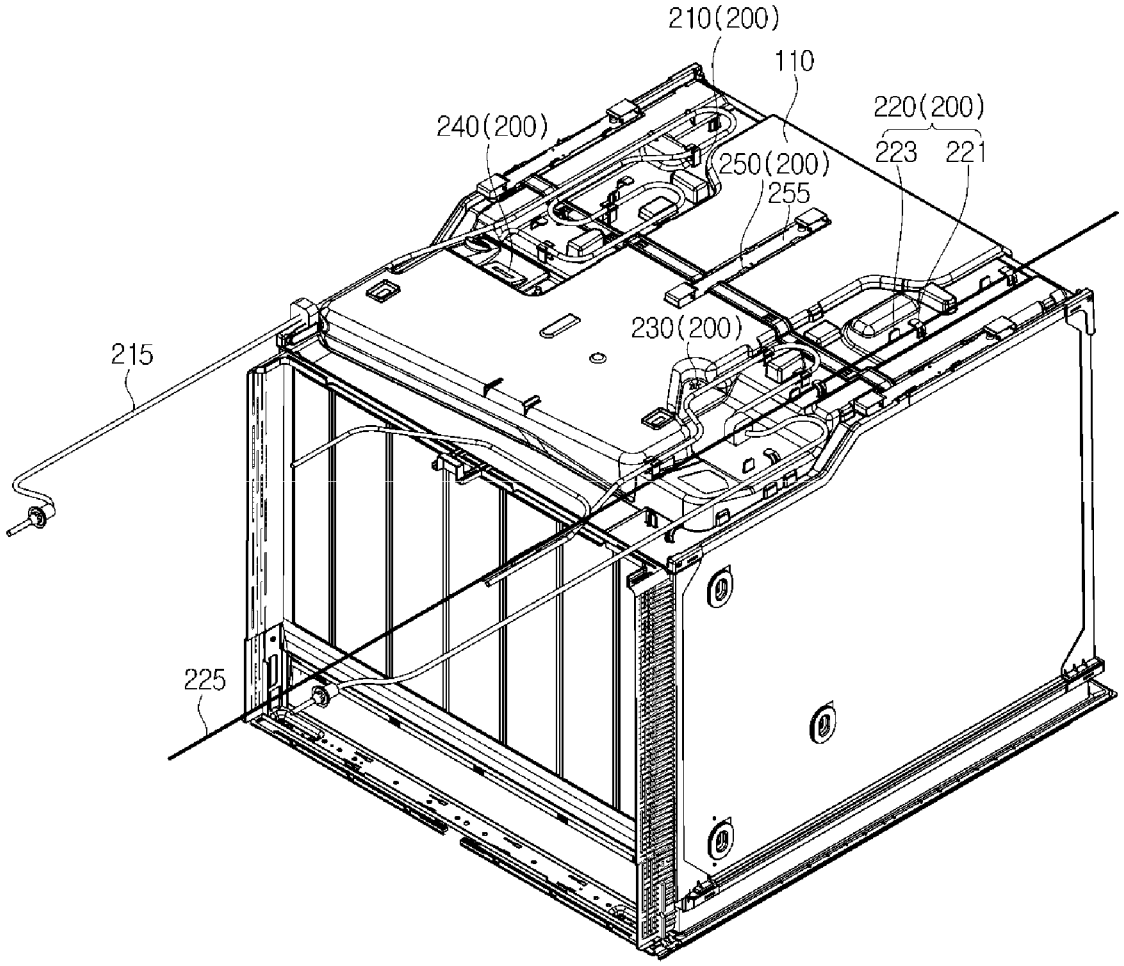
FIG. 4 is a view showing a plurality of fixers for fixing a plurality of components according to one embodiment of the present disclosure being integrally formed with a first inner case.
Figure 5:
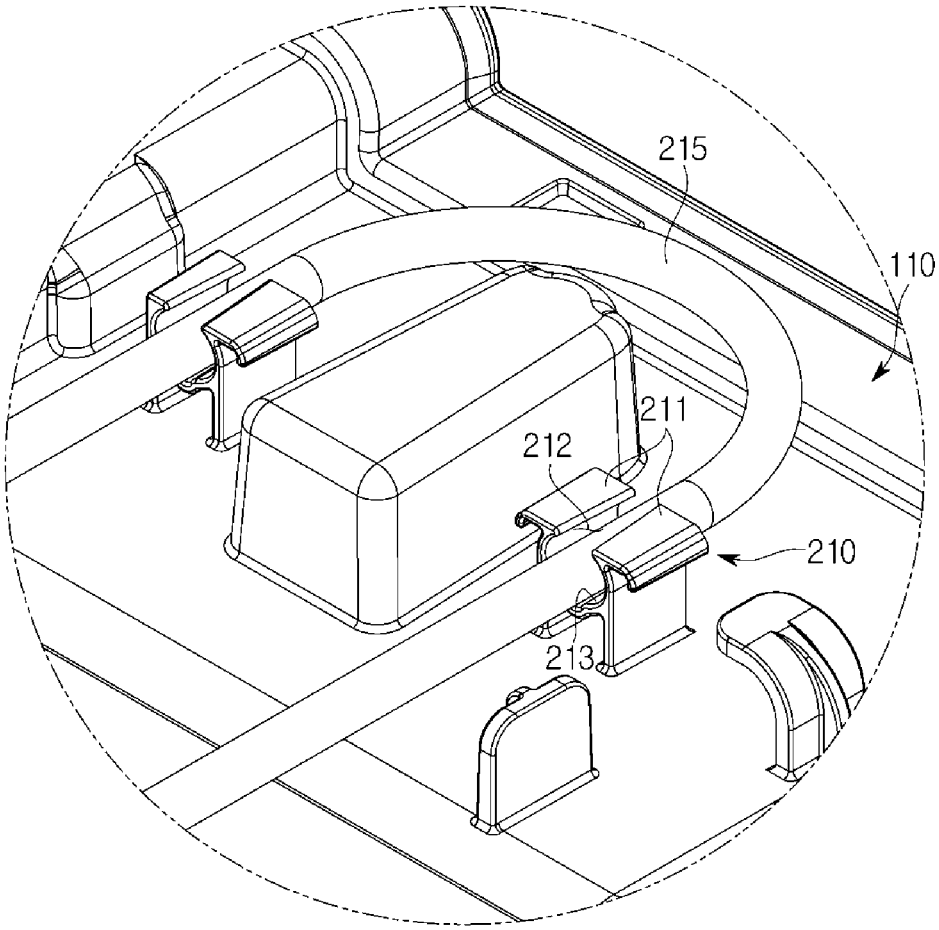
FIG. 5 is a view showing a suction pipe fixed to a suction pipe fixer according to one embodiment of the present disclosure.
Figure 6:
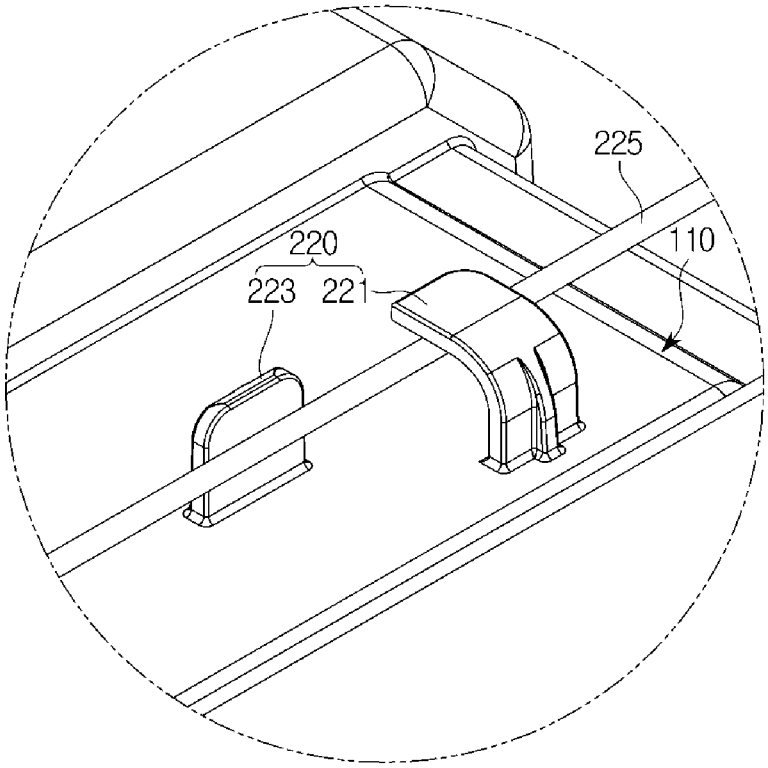
FIG. 6 is a view showing a main wire fixed to a main wire fixer according to one embodiment of the present disclosure.
Figure 7:
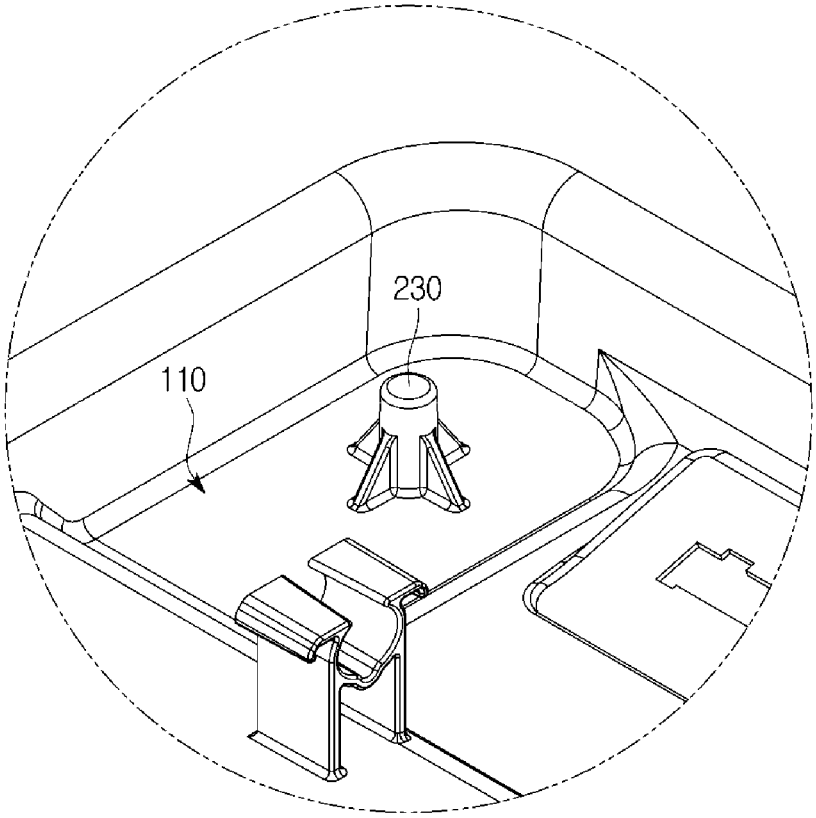
FIG. 7 is a view showing a screw fastener formed in the first inner case according to one embodiment of the present disclosure.
Figure 8:
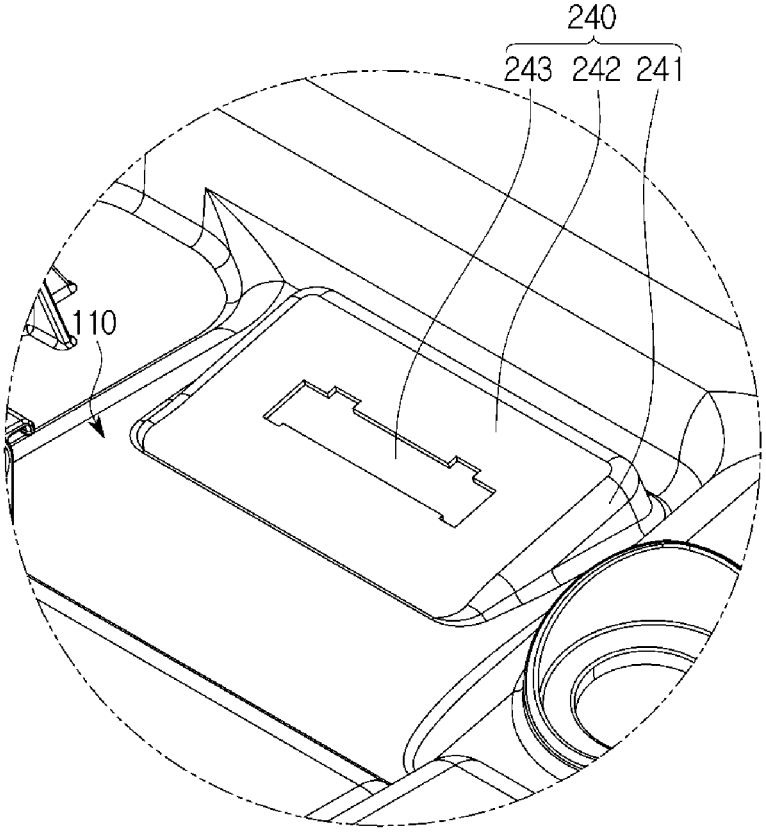
FIG. 8 is a view showing a wire housing fixer formed in the first inner case according to one embodiment of the present disclosure.
Figure 9:
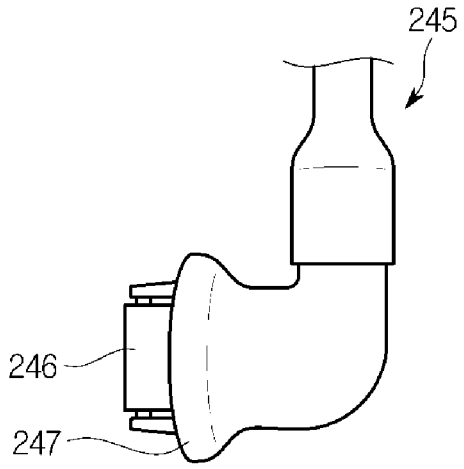
FIG. 9 is a view showing a wire housing according to one embodiment of the present disclosure.
Figure 10:
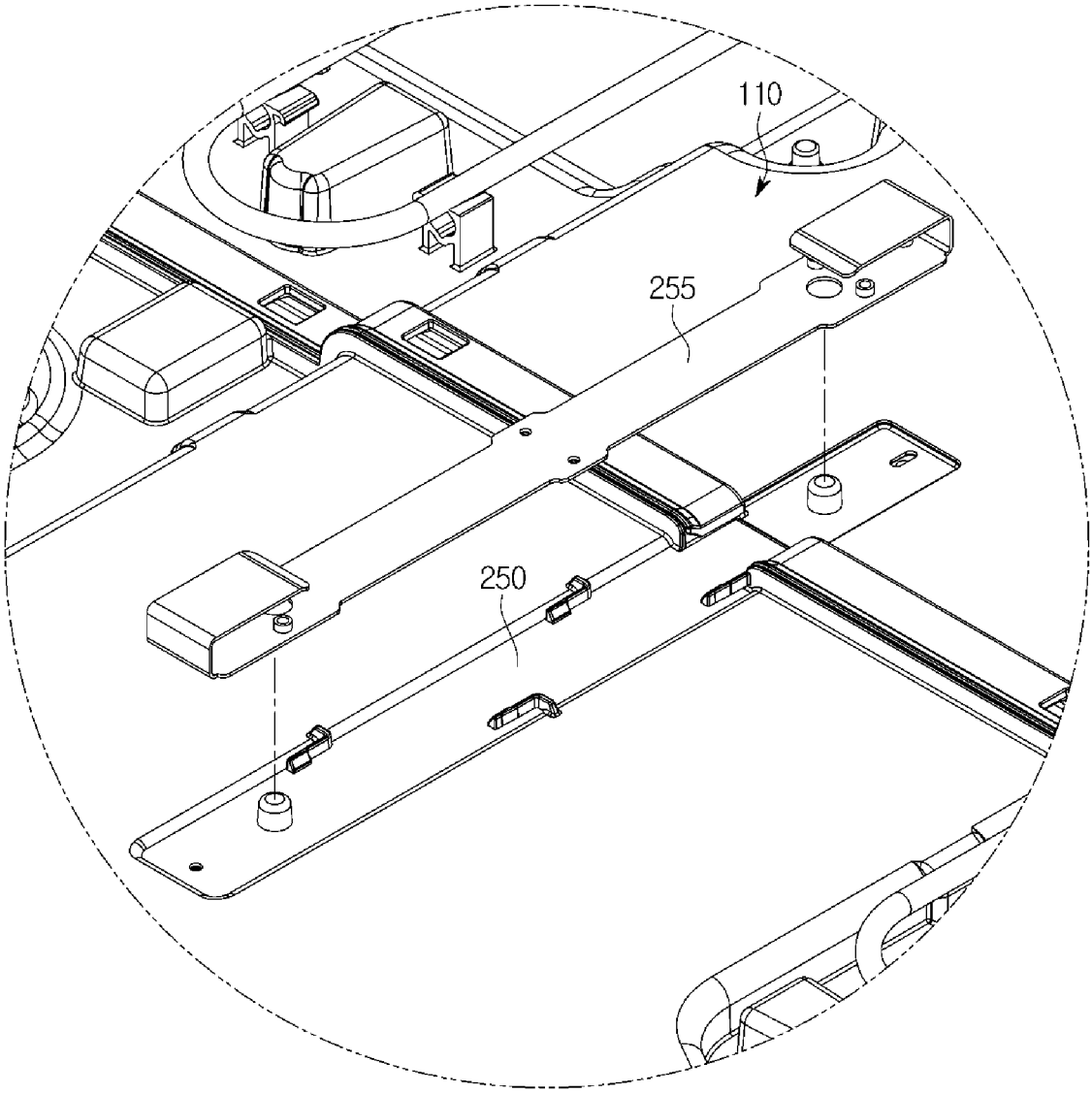
FIG. 10 is a view showing a shelf reinforcing plate fixed to a shelf reinforcing plate fixer according to one embodiment of the present disclosure.

FIG. 4 is a view showing a plurality of fixers for fixing a plurality of components according to one embodiment of the present disclosure being integrally formed with the first inner case, FIG. 5 is a view showing a suction pipe fixed to a suction pipe fixer according to one embodiment of the present disclosure, FIG. 6 is a view showing a main wire fixed to a main wire fixer according to one embodiment of the present disclosure, FIG. 7 is a view showing a screw fastener formed in the first inner case according to one embodiment of the present disclosure, FIG. 8 is a view showing a wire housing fixer formed in the first inner case according to one embodiment of the present disclosure, FIG. 9 is a view showing a wire housing according to one embodiment of the present disclosure, and FIG. 10 is a view showing a shelf reinforcing plate fixed to a shelf reinforcing plate fixer according to one embodiment of the present disclosure.

As shown in FIG. 4, a plurality of components are fixed to the rear plate 115 of the injection-molded first inner case 110, and a plurality of fixers 200 for fixing the components may be integrally formed with the rear plate 115.

The plurality of fixers 200 may be integrally injection-molded with the rear plate 115 of the first inner case 110.

The plurality of components fixed to the rear plate 115 of the first inner case 110 may include a suction pipe 215, a main wire 225, screws 235, a wire housing 245, a shelf reinforcing plate 255, and the like.

As shown in FIG. 5, a suction pipe fixer 210 for fixing the suction pipe 215 may be integrally injection-molded with the rear plate 115 of the first inner case 110.

A plurality of suction pipe fixers 210 are provided and may include an inserter 211 including an opening 212 into which the suction pipe 215 is inserted and a mounter 213 on which the suction pipe 215 inserted into the opening 212 is mounted.

Because the injection-molded suction pipe fixer 210 has elasticity, the opening 212 may be widened so that the suction pipe 215 passes through the opening 212 when the suction pipe 215 is inserted into the opening 212.

When the suction pipe 215 is inserted into the opening 212, the opening 212 is narrowed to an original size thereof by the elasticity to prevent the suction pipe 215 from escaping through the opening 212.

As in a case in which the suction pipe 215 is separated through the opening 212, the opening 212 is widened during separation of the suction pipe 215, and the opening 212 is narrowed to the original size by the elasticity after the separation of the suction pipe 215.

Since the suction pipe fixer 210 is integrally formed with the first inner case 110, it is not necessary fora separate component for fixing the suction pipe 215 to be attached to the inner case 11 after the inner case 11 is formed.

As shown in FIG. 6, main wire fixers 220 for fixing the main wire 225 may be integrally provided at the rear plate 115 of the first inner case 110.

The plurality of main wire fixers 220 are provided and may include a first fixer 221 and a second fixer 223 provided to be separated from each other to form a space into which the main wire 225 is inserted.

Since the main wire fixers 220 are integrally formed with the first inner case 110, it is not necessary for a separate component for fixing the main wire 225 to be attached to the inner case 11 after the inner case 11 is formed.

As shown in FIG. 7, screw fasteners 230 to which screws (not shown) are fastened to be fixed may be integrally provided at the rear plate 115 of the first inner case 110.

The screws are fastened to the rear plate 115 of the first inner case 110 from an inside of the storage compartment 20 to fix various components to the inside of the storage compartment 20, and the screw fasteners 230 for fastening screws may be provided to protrude from the rear plate 115 of the first inner case 110 toward the outside of the storage compartment 20.

The plurality of screw fasteners 230 are provided to have an empty space in which the screws may be fastened.

Since the screw fasteners 230 are integrally formed with the first inner case 110, it is not necessary for a separate component for fastening a screw to be attached to the inner case 11 after the inner case 11 is formed.

As shown in FIGS. 8 to 9, a wire housing fixer 240 for fixing the wire housing 245 may be integrally provided at the rear plate 115 of the first inner case 110.

The wire housing fixer 240 may include an inclined part 241 protruding from the rear plate 115 of the first inner case 110 to have an inclined surface 242, and a connection hole 243 to which the wire housing 245 is connected.

Since various components are coupled to the rear plate 115 of the first inner case 110, the rear plate 115 of the first inner case 110 may be provided not to have a uniform thickness, and thus may have a relatively thin thickness.

When the wire housing 245 is fixed to a relatively thin portion of the rear plate 115 of the first inner case 110, the wire housing 245 may not be rigidly fixed thereto.

However, since the inclined part 241 of the wire housing fixer 240 is provided to protrude from the rear plate 115 of the first inner case 110, the inclined part 241 is not affected by the components coupled to the rear plate 115 of the first inner case 110, and thus may have a sufficient thickness to rigidly fix the wire housing 245.

The inclined surface 242 of the inclined part 241 may be provided so that water easily flows on an inner side of the rear plate 115 of the first inner case 110.

The wire housing 245 may include a connector 246 inserted into the connection hole 243 of the wire housing fixer 240, and a sealer 247 sealing around the connection hole 243 to prevent the insulator from passing through the connection hole 243 when the insulator is foamed.

Since the wire housing fixer 240 is integrally formed with the first inner case 110, it is not necessary for a separate component for fixing the wire housing 245 to be attached to the inner case 11 after the inner case 11 is formed.

As shown in FIG. 10, shelf reinforcing plate fixers 250 for fixing the shelf reinforcing plate 255 may be integrally provided at the rear plate 115 of the first inner case 110.

The shelf reinforcing plate 255 may be fixed to the rear plate 115 of the first inner case 110 so that the shelf 25 to be coupled to the first inner case 110 is rigidly coupled to the first inner case 110.

The plurality of shelf reinforcing plate fixers 250 may be provided.

As described above, since the suction pipe fixer 210 for fixing the suction pipe 215, the main wire fixer 220 for fixing the main wire 225, the screw fastener 230 for fastening a screw, the wire housing fixer 240 for fixing the wire housing 245, and the shelf reinforcing plate fixer 250 for fixing the shelf reinforcing plate 255 are integrally formed with the first inner case 110, it is not necessary for a separate component to be attached to the inner case 11 after the inner case 11 is formed, and thus the number of components separately attached to the inner case 11 and an amount of subsidiary material can be reduced, and a working process can be simplified.

Figure 11:
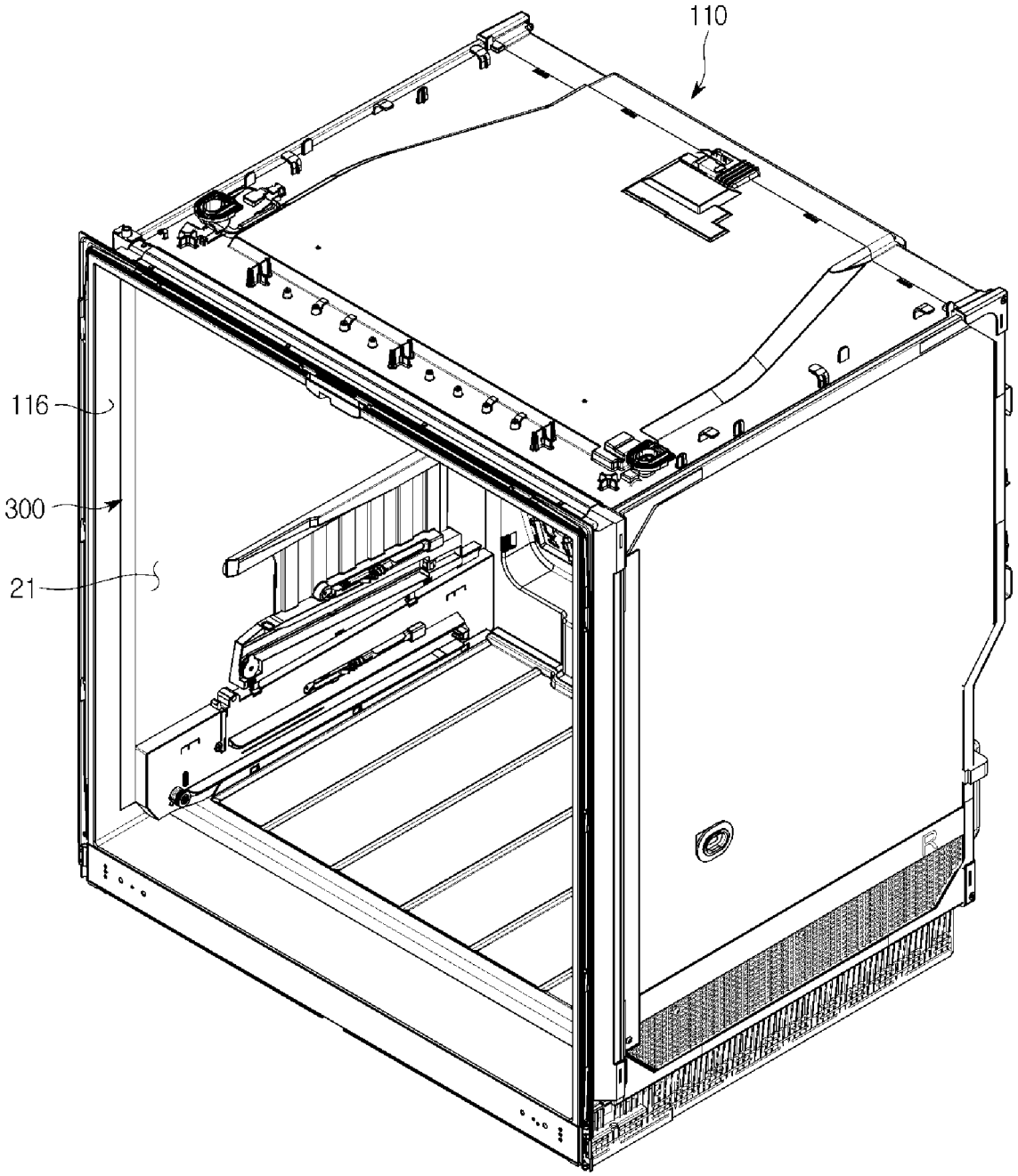
FIG. 11 is a view showing a light emitting diode (LED) assembly assembled on a front cover of the first inner case according to one embodiment of the present disclosure.
Figure 12:
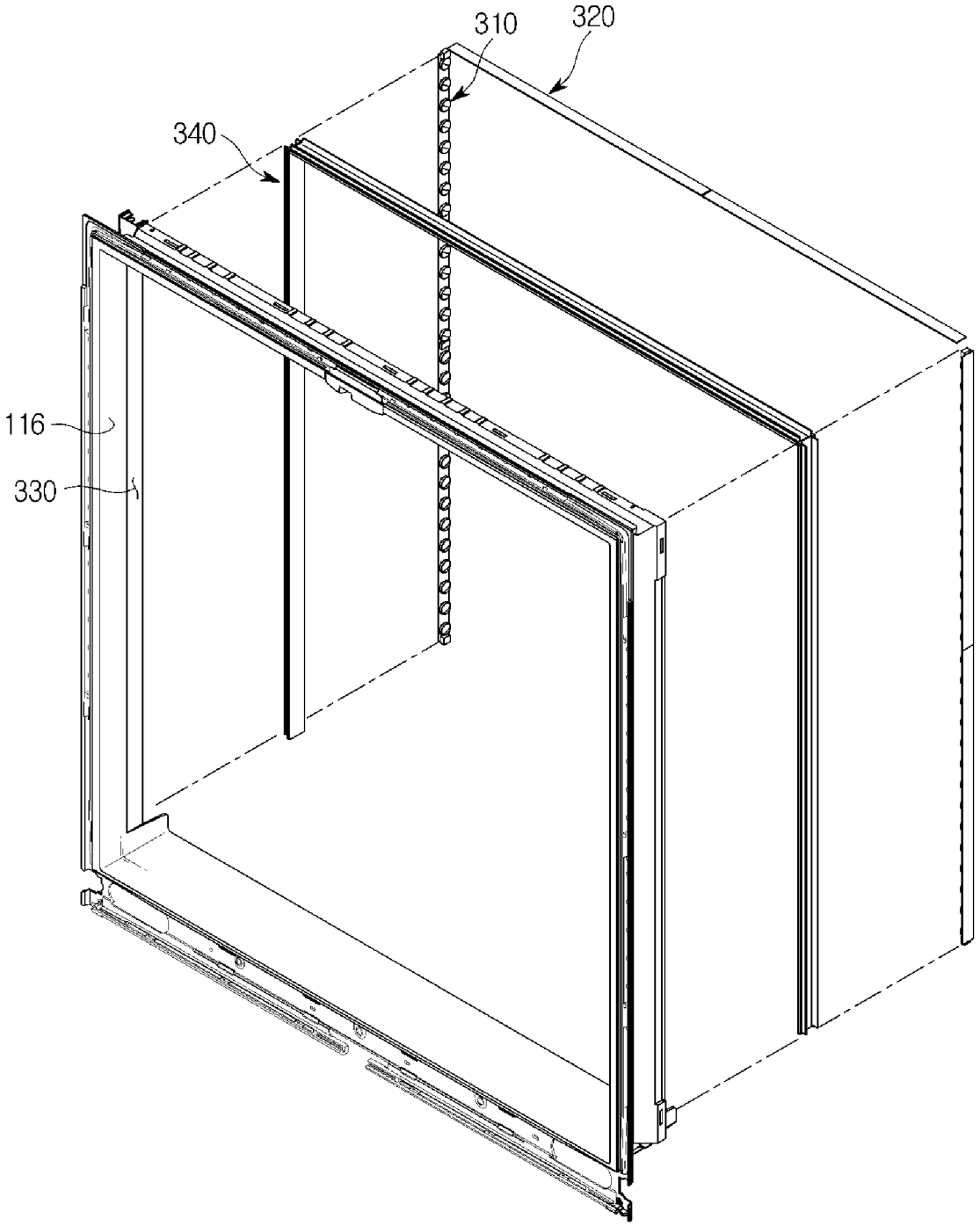
FIG. 12 is a view showing the LED assembly according to one embodiment of the present disclosure fixed to left, right, and upper surfaces of the front cover.
Figure 13:
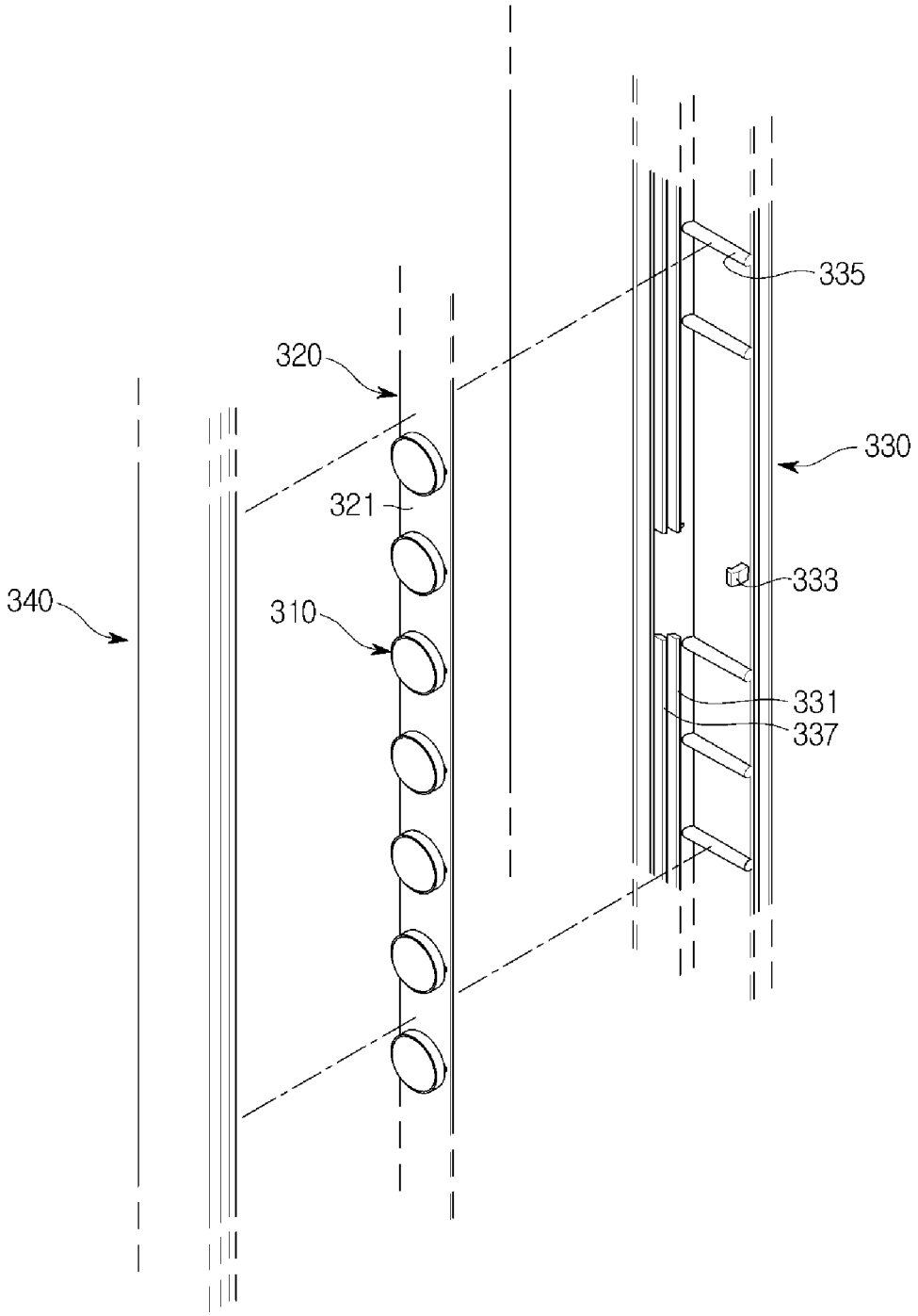
FIG. 13 is a view showing the LED assembler assembled with a printed circuit board and an LED cover according to one embodiment of the present disclosure.
Figure 14:
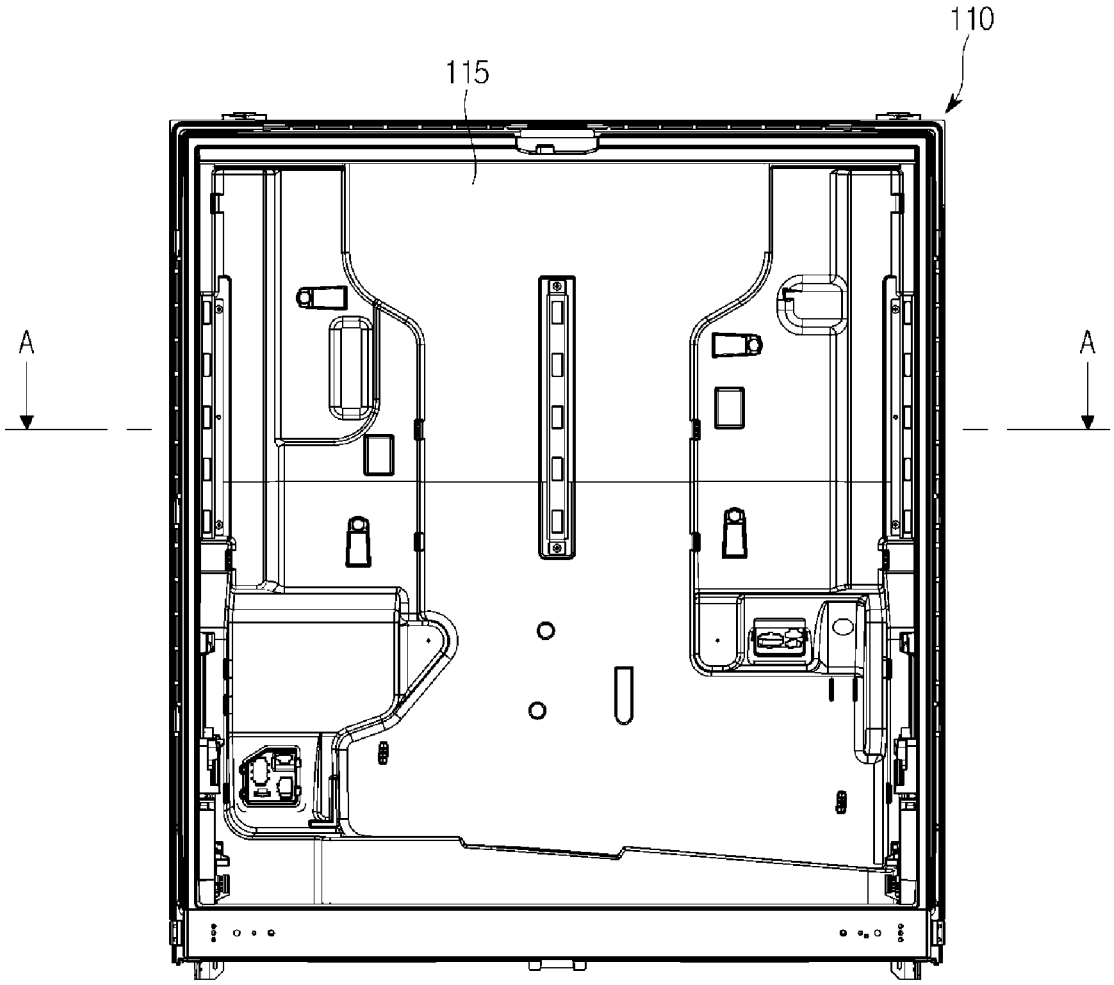
FIG. 14 is a view showing a rear surface of the first inner case according to one embodiment of the present disclosure.
Figure 15:
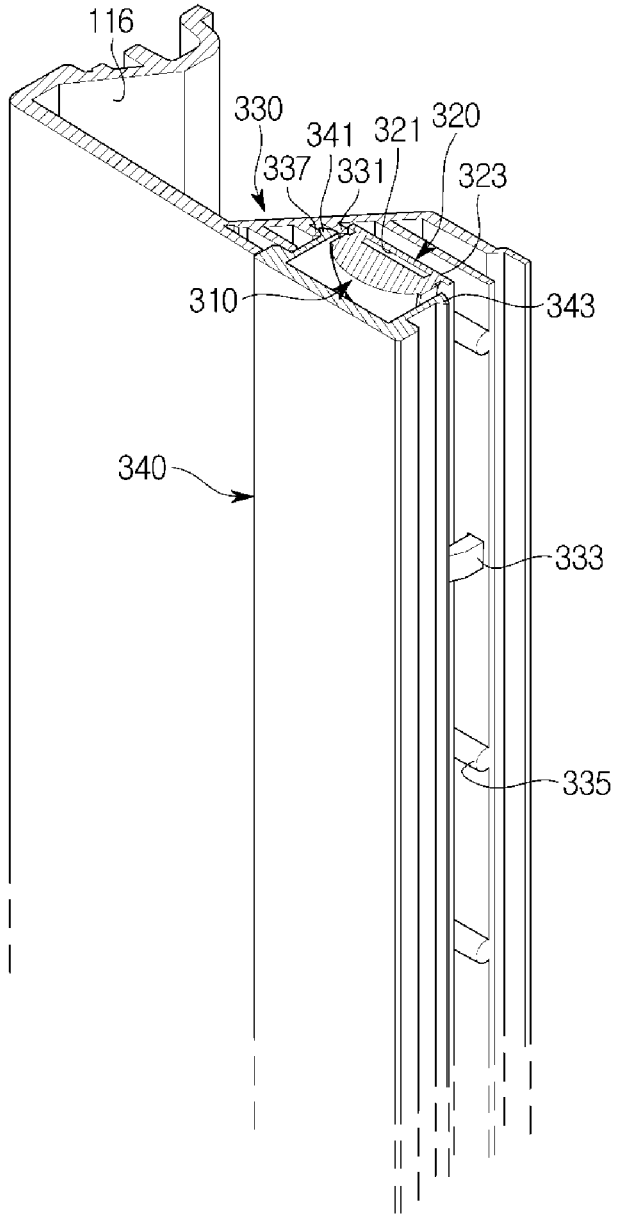
FIG. 15 is a view taken along line A-A of FIG. 14 after the LED assembler is assembled with the printed circuit board and the LED cover according to one embodiment of the present disclosure.
Figure 16:
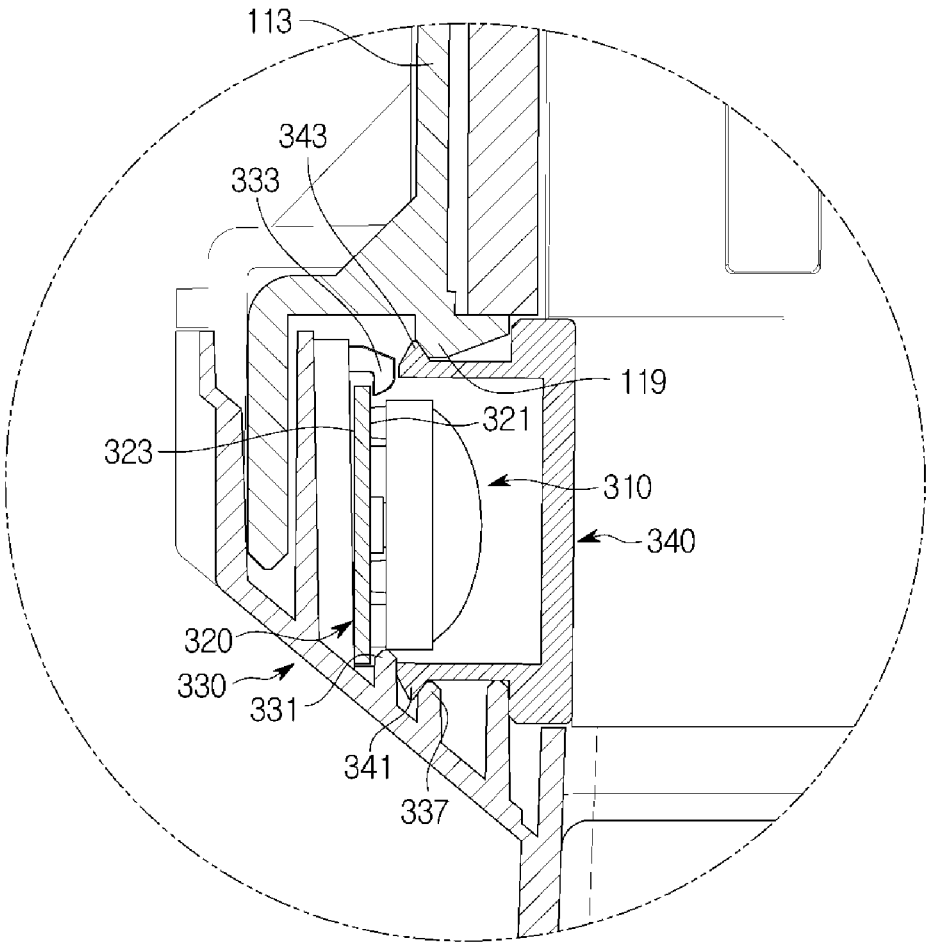
FIG. 16 is a cross-sectional view taken along line A-A of FIG. 14.

FIG. 11 is a view showing a light emitting diode (LED) assembly assembled on a front cover of the first inner case according to one embodiment of the present disclosure, FIG. 12 is a view showing the LED assembly according to one embodiment of the present disclosure fixed to left, right, and upper surfaces of the front cover, FIG. 13 is a view showing the LED assembler assembled with a printed circuit board and an LED cover according to one embodiment of the present disclosure, FIG. 14 is a view showing a rear surface of the first inner case according to one embodiment of the present disclosure, FIG. 15 is a view taken along line A-A of FIG. 14 after the LED assembler is assembled with the printed circuit board and the LED cover according to one embodiment of the present disclosure, and FIG. 16 is a cross-sectional view taken along line A-A of FIG. 14.

As shown in FIGS. 11 to 13, the LED assembly 300 may be assembled on upper, left, and right surfaces of the front cover 116 to be disposed in the storage compartment 20.

In the drawings, the LED assembly 300 is assembled on the upper, left, and right surfaces of the front cover 116, but is not limited thereto.

The LED assembly 300 may be provided on three surfaces of the front cover 116 to have a long length, and may include a plurality of LEDs 310, a printed circuit board 320 on which the plurality of LEDs 310 are mounted, an LED assembler 330 forming a space for assembling the printed circuit board 320 so that the printed circuit board 320 is assembled therein, and an LED cover 340 covering the LED assembler 330 to prevent exposure of the LED 310.

The printed circuit board 320 may include a first surface 321 on which the plurality of LEDs 310 are mounted and a second surface 323 which is a side opposite the first surface 321 (see FIG. 16).

The LED assembler 330 is provided to be integrated with the front cover 116, and may be provided to be concave from the upper, left, and right surfaces of the front cover 116 toward the outside of the upper storage compartment 21 to form a space in which the printed circuit board 320 is assembled.

As shown in FIGS. 13 to 16, the LED assembler 330 may include a first fixing rib 331 to which one side of the first surface 321 of the printed circuit board 320 is fixed, a fixing hook 333 to which the other side of the first surface 321 is fixed, and a supporting rib 335 supporting the second surface 323 of the printed circuit board 320 so that the printed circuit board 320 is fixed to the first fixing rib 331 and the fixing hook 333.

The first fixing rib 331 may be provided at one side wall of the LED assembler 330, and the fixing hook 333 may be provided at a side wall opposite the one side wall of the LED assembler 330 on which the first fixing rib 331 is provided.

The supporting rib 335 may be provided at a concave bottom of the LED assembler 330.

The second surface 323 of the printed circuit board 320 is supported by the supporting rib 335, and the first surface 321 is fixed to the first fixing rib 331 and the fixing hook 333, and thus the printed circuit board 320 may be fixed between the supporting rib 335, the first fixing rib 331, and the fixing hook 333.

Further, the LED assembler 330 may further include a second fixing rib 337 to which one side of the LED cover 340 is fixed.

The other side of the LED cover 340 may be caught by catchers 119 provided at the upper plate 111, the left plate 113, and the right plate 114, which are coupled to the front cover 116, to be fixed.

The LED cover 340 may include a first fixing protrusion 341 provided at the one side of the LED cover 340 and fixed to the second fixing rib 337 of the LED assembler 330, and a second fixing protrusion 343 provided at the other side of the LED cover 340 and caught by the catchers 119, which are provided at the upper plate 111, the left plate 113, and the right plate 114, which are coupled to the front cover 116, to be fixed.

The first fixing protrusion 341 and the second fixing protrusion 343 of the LED cover 340 are respectively fixed to the second fixing rib 337 of the LED assembler 330 and the catcher 119 such that the LED cover 340 covers the open portion of the LED assembler 330, and thus the LED 310 and the printed circuit board 320 assembled in the LED assembler 330 are not exposed to the outside.

As described above, the LED assembler 330 is integrally provided in the front cover 116, and the LED cover 340 is easily coupled to the LED assembler 330 by the first fixing protrusion 341 and the second fixing protrusion 343 to cover the LED assembler 330, and thus an assembled component can be simplified and a simple design can be implemented.

As is apparent from the above description, a refrigerator can allow the number of components and an amount of subsidiary material to be reduced and can have a simple working process due to fixers for fixing various components to an inner case being integrally provided in the inner case so that it is not necessary for a separate component for fixing various components to the inner case to be attached to the inner case.

Further, a refrigerator can have a simplified component and a simple design due to an LED assembler in which a printed circuit board having LEDs mounted thereon being assembled and which is integrally provided in an inner case.

In the description of the refrigerator with reference to the accompanying drawings, although a specific shape and direction have been primarily described, the shape and direction may be variously changed and modified by those skilled in the art. It should be recognized that changes and modifications that fall within the scope of the present disclosure are included in the scope of the present disclosure.

What is claimed is:

1. A refrigerator comprising:

an inner case including an upper plate, a lower plate, a left plate, a right plate, a rear plate, and a front cover to form a storage compartment;

an outer case coupled to an outer side of the inner case to form an exterior; and a light emitting diode (LED) assembly provided on at least one of upper, left, and right surfaces of the front cover to be disposed in the storage compartment, wherein the LED assembly includes a printed circuit board on which a plurality of LEDs are mounted, an LED assembler provided to be integrated with the front cover and configured to form a space for assembling the printed circuit board so that the printed circuit board is assembled therein, and an LED cover configured to cover the LEDs to prevent exposure of the LEDs, wherein the printed circuit board includes a first surface on which the LEDs are mounted and a second surface which is a surface opposite the first surface, and wherein the LED assembler includes:

a first fixing rib to which one end of the first surface is fixed;

a fixing hook to which an other end of the first surface is fixed; and a supporting rib configured to support the second surface of the printed circuit board so that the printed circuit board is fixed to the first fixing rib and the fixing hook.

2. The refrigerator according to claim 1, wherein the LED assembler is provided on all of the upper, left, and right surfaces of the front cover.

3. The refrigerator according to claim 2, wherein the LED assembler is concave from the upper, left, and right surfaces of the front cover toward the outer case to form a space for assembling the printed circuit board.

4. The refrigerator according to claim 1, wherein the LED assembler further includes a second fixing rib to which one side of the LED cover is fixed.

5. The refrigerator according to claim 4, wherein the other side of the LED cover is caught by catchers to be fixed, and the catchers are provided at the left plate, the right plate, and the upper plate, which are coupled to the front cover.

6. The refrigerator according to claim 5, wherein the LED cover includes:

a first fixing protrusion fixed to the second fixing rib; and a second fixing protrusion fixed to the catcher.

* * * * *